US007439662B2

(12) United States Patent
Arndt et al.

(10) Patent No.: US 7,439,662 B2
(45) Date of Patent: Oct. 21, 2008

(54) LAMP WITH SINGLE-SIDED SOCKET

(75) Inventors: Joachim Arndt, Brieselang (DE); Uwe Fidler, Berlin (DE); Jürgen Gräf, Augsburg (DE); Markus Herb, Günzburg (DE); Anton Schlögl, Biberbach (DE); Jürgen Waldmann, Berlin (DE); Bernhard Zöllner, Westendorf (DE)

(73) Assignee: Patent - Trewhand - Gesellschaft für elektrische Glühlampen mbH, Munich (DE)

( * ) Notice: Subject to any disclaimer, the term of this patent is extended or adjusted under 35 U.S.C. 154(b) by 287 days.

(21) Appl. No.: 10/567,490

(22) PCT Filed: Jul. 30, 2004

(86) PCT No.: PCT/DE2004/001710

§ 371 (c)(1),
(2), (4) Date: Apr. 7, 2006

(87) PCT Pub. No.: WO2005/015605

PCT Pub. Date: Feb. 17, 2005

(65) Prior Publication Data

US 2006/0226754 A1 Oct. 12, 2006

(30) Foreign Application Priority Data

Aug. 7, 2003 (DE) ..... 103 36 282

(51) Int. Cl.
*H01J 5/48* (2006.01)
*H01J 5/50* (2006.01)

(52) U.S. Cl. ..... 313/318.09; 313/318.12; 313/318.03; 313/113

(58) Field of Classification Search ..... None
See application file for complete search history.

(56) References Cited

U.S. PATENT DOCUMENTS 5,576,591 A 11/1996 Block et al.
5,600,198 A * 2/1997 Meade et al. ..... 313/318.01
6,078,128 A * 6/2000 Gagnon et al. ..... 313/113
6,319,046 B1 11/2001 Feye-Hohmann et al.
6,411,036 B1 6/2002 Bugenske (Continued)

FOREIGN PATENT DOCUMENTS

DE 43 17 252 5/1994

(Continued)

*Primary Examiner*—Ashok Patel
(74) *Attorney, Agent, or Firm*—William E. Meyer

(57) ABSTRACT

Electric lamp with a base at one end, having an inner vessel surrounded by an outer jacket, a base with electric connections supporting the inner vessel and the outer jacket, having the following features:

a) the base has a base insulator with a central opening with a surrounding collar in which the inner vessel is held without cement;

b) the base insulator has a circular, radially projecting segment with an associated upper and lower plateau with reference to the base;

c) the outer jacket has a circular opening on the base side with a radially projecting edge that has an upper and lower contact surface with reference to the base, the lower contact surface of the edge being compatible with the upper plateau of the circular, radially projecting segment at the base insulator; and d) the outer jacket is fastened on the base by a cementless mechanical holding mechanism.

17 Claims, 9 Drawing Sheets

U.S. PATENT DOCUMENTS

| | | | | |
|---|---|---|---|---|
| 6,469,428 | B1 | 10/2002 | Thiel et al. | |
| 2003/0071556 | A1* | 4/2003 | Itaya et al. | 313/318.08 |
| 2004/0080253 | A1* | 4/2004 | Jurkovic et al. | 313/318.01 |

FOREIGN PATENT DOCUMENTS

| | | | |
|---|---|---|---|
| DE | 199 14 308 | | 12/1999 |
| DE | 198 56 871 | | 6/2000 |
| EP | 0 639 849 | A1 | 2/1995 |
| EP | 1 109 199 | | 6/2001 |
| JP | 05 135688 | A | 6/1993 |
| JP | 06 028971 | A | 2/1994 |
| WO | WO-98/11590 | A | 3/1998 |

* cited by examiner

LAMP WITH SINGLE-SIDED SOCKET

TECHNICAL FIELD

The invention relates to a lamp with a base at one end in accordance with the preamble of claim 1. What is involved here, in particular, are high pressure discharge lamps, preferably metal halide lamps, but also, for example, halogen lamps. Use is frequently made in this case of an elongated, in particular ceramic, discharge vessel as lamp bulb.

PRIOR ART

DE-C1-43 17 252 has already disclosed a lamp with a base at one end and that is constructed from three bulbs. It has a ceramic adapter that is mounted on a screw base. Atmospheric pressure prevails between the glass envelope and the outer bulb.

EP-A 1 109 199 describes a high pressure lamp with a base at one end and in the case of which the outer bulb is surrounded by a reflector. The base is fastened directly on the reflector neck by means of crimping. It is disadvantageous here that the dimensioning of the neck of the reflector must be coordinated with the standard dimensions of the base.

DE-A 199 14 308 describes an insulation piercing contact that includes at least one piercing element and a spring element.

SUMMARY OF THE INVENTION

It is an object of the present invention to provide a lamp with a base at one end in accordance with the preamble of claim 1 which is easy to mount and can be produced effectively in an automatable fashion.

This object is achieved by means of the characterizing features of claim 1. Particularly advantageous refinements are to be found in the dependent claims.

The inventive lamp with a base at one end has an inner vessel sealed in a vacuum-tight fashion, in particular a lamp bulb of an incandescent lamp, or else an elongated discharge vessel that is also accommodated in an outer bulb, if required. The inner vessel is also surrounded by an outer jacket. The inner vessel is preferably a subassembly of a discharge vessel with outer bulb. It is particularly preferred here to be a ceramic discharge vessel, in particular for a metal halide lamp, for example for general lighting purposes. Here, a base with electrical connections carries the inner vessel, on the one hand, and the outer jacket, on the other hand. The electrical connections are normally connected to supply leads that make electric contact with a luminous means in the interior of the inner vessel, for example the luminous means being realized by electrodes or a filament of an incandescent lamp. Without restricting the invention, it is also possible to use external electrodes or a configuration without electrodes. Instead of a ceramic discharge vessel, it is also possible to use a discharge vessel made from quartz glass or hard glass. An outer bulb as part of the inner vessel is not mandatory, but is desirable.

According to the invention, the following combination of features is used so as to eliminate complicated frame mounting and hot processes such as sealing or baking the base cement:

a) the base has a base insulator that is produced from an insulating material and has an axially aligned, central opening with a surrounding collar in which the inner vessel is held without cement;

b) the base insulator has means that enable the outer jacket to be held without cement; in particular, the means is a radially projecting segment that is, in particular, circular and has associated upper and lower plateaus with reference to the base;

c) the outer jacket has an in particular circular opening on the base side and has means for holding on the base insulator that cooperate with the holding means of the base insulator; what is involved, in particular, is a radially projecting edge or edge section that has lower and upper contact surfaces with reference to the base; the lower contact surface of the edge or edge section being compatible with the upper plateau of the radially projecting segment on the base insulator;

d) the outer jacket is fastened on the base by means of a cementless mechanical holding mechanism with the inclusion of the means from b) and c).

In a first embodiment with segment, in particular, the outer jacket is fastened on the base insulator by virtue of the fact that a clamping part bridges the distance between the lower plateau of the base insulator and at least the upper contact surface of the edge, doing so in a holding fashion.

Alternatively, in a second embodiment the outer jacket can have an inbuilt clamping function, the outer jacket being held in the upper part of the base insulator at the collar thereof, for example by crimping.

In addition to the base insulator, the base has a customary part facing the socket, for example a screw base attachment or a bayonet base attachment or a GU base.

The inner vessel, that is to say, for example, the lamp bulb or the outer bulb that contains a discharge vessel, or the discharge vessel in the case of the absence of an outer bulb, is preferably held in the central opening by means of a spring clip. This technique is known in principle per se, see DE 198 56 871, for example.

In particular, when use is made of a radially projecting segment, the edge of the outer jacket and the segment of the base insulator is equipped with a cooperating antirotation mechanism.

A simple, reliable and cost-effective solution for holding the outer jacket consists in the clamping part comprising clamps distributed over the circumference, or a peripheral clamping strip. In particular, the clamping strip is a deformable ring that is produced, for example, from metal or plastic such that a very simple form of holding is possible by virtue of the fact that the clamping strip is firstly applied to the lower plateau in a fashion already angled away, and is then pulled up onto the stop over the projecting segment. As soon as the outer jacket is mounted, the clamping strip, preferably a ring made from aluminum, can be integrally formed mechanically on the projecting segment up to the upper contact surface. The edge of the outer jacket is fixed by bending around the upper contact surface.

A damping means is preferably introduced between the clamping part and upper contact surface of the edge of the outer jacket. This is, in particular, a type of O ring, for example made from an elastomer. The material of the outer jacket, advantageously glass or aluminum, is thereby protected against damage during the process of integral formation. A further advantage is that the connecting force between the outer jacket and segment is thereby maintained in a fashion free from backlash over the lifetime of the lamp. Because of the damping ring, the stress of the clamping part can be raised without risk, and the connection can therefore be fashioned more reliably.

Supply leads are usually led out of the lamp bulb and are connected to the electrical connections of the base. A particularly flexible and time saving solution consists in using clamping connections such as are known per se, for example, from DE-A 199 14 308 for the connection between the electrical connections and the supply leads.

Moreover, the base usually has a part facing the socket that is connected at least partially to the base insulator by means of crimping, and is known per se. This part includes, for example, a conventional screw thread or pins of a bayonet base, etc.

The outer jacket can be, for example, a closed part such as a further outer bulb, although without a vacuum-tight seal, or else a spherical cap that has a reflector contour.

A typical application is a metal halide lamp that contains a filling with or without a mercury component, for example with inert ignition gas, advantageously rare gas.

BRIEF DESCRIPTION OF THE DRAWINGS

The aim below is to explain the invention in more detail with the aid of a number of exemplary embodiments. In the drawing.

PREFERRED EMBODIMENT OF THE INVENTION

Figure 1:
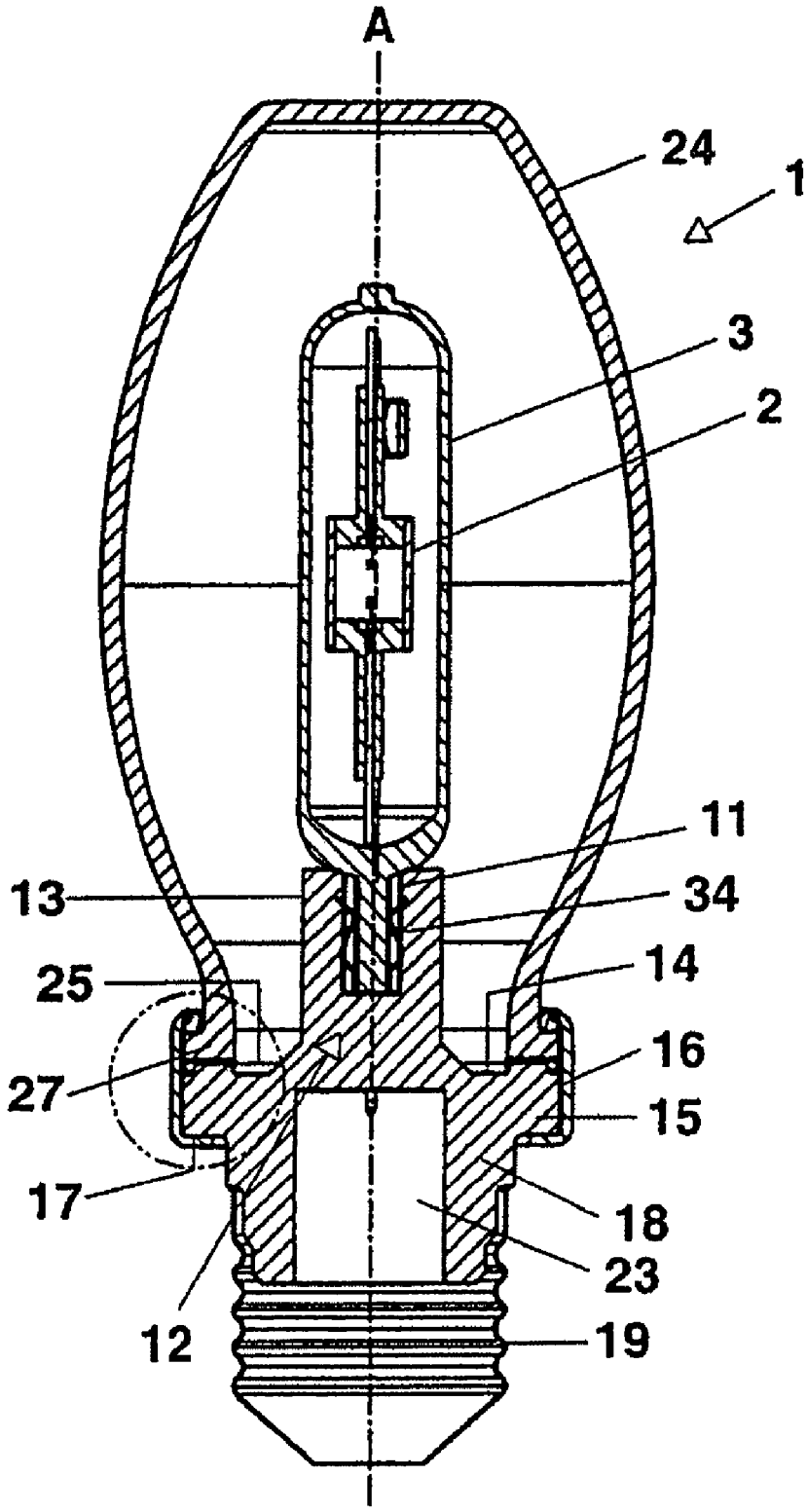
FIG. 1 shows a metal halide lamp in side view.
Figure 2:
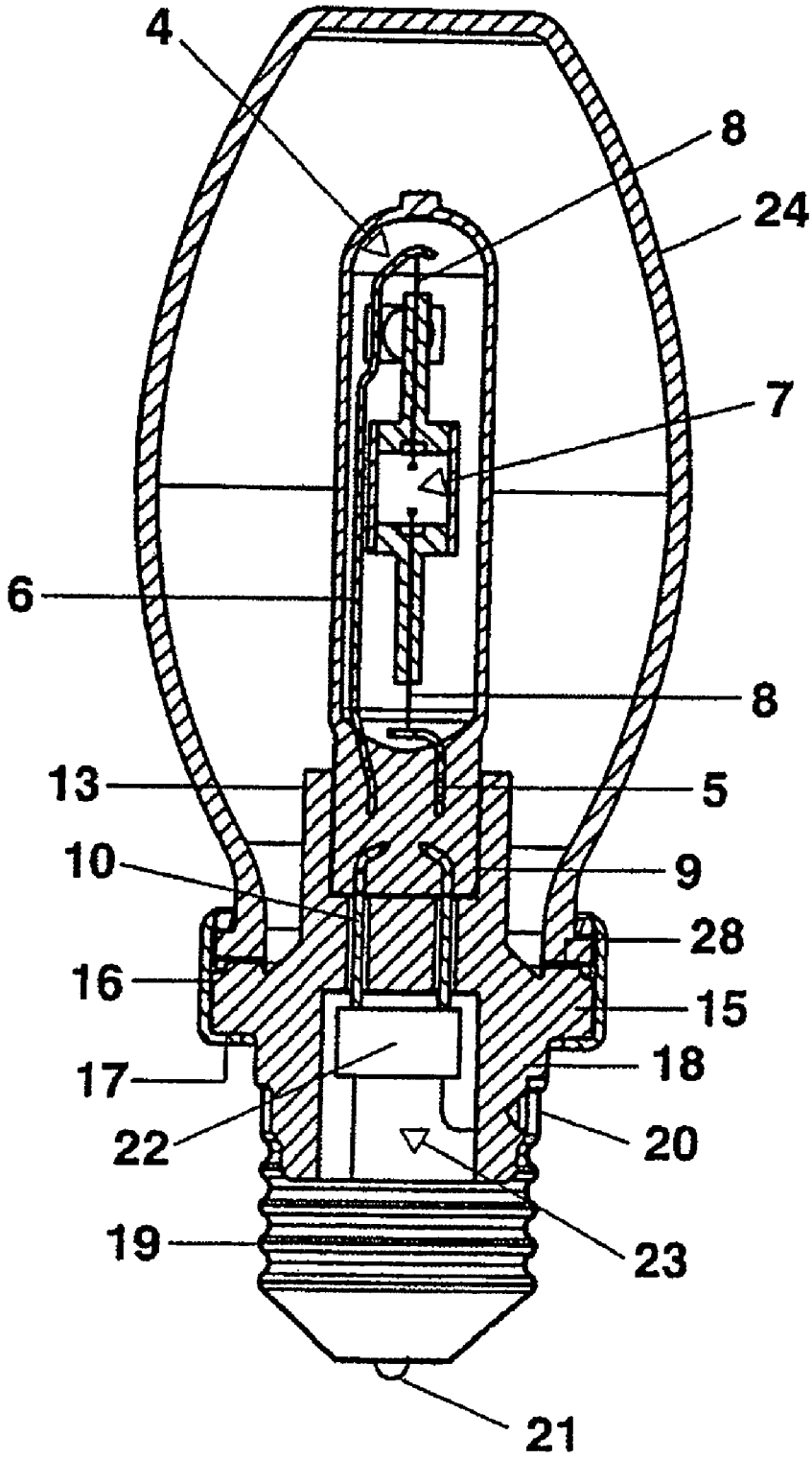
FIG. 2 shows the lamp of FIG. 1 in a side view rotated by 90°.

An exemplary embodiment of a metal halide lamp 1 is shown in FIGS. 1 and 2, respectively rotated by 90° relative to one another. A ceramic discharge vessel 2, which is sealed at both ends, is arranged longitudinally in the lamp axis A. It is closely surrounded by an outer bulb 3 that is pinched at one end and made from hard glass. Both parts 2, 3 together form the inner vessel (2, 3). A frame 4 with short and long lead wires 5, 6 holds the discharge vessel 2 in the outer bulb 3. The electrodes 7 in the interior of the discharge vessel are connected to the lead wires 5, 6 via leadthroughs 8. Said lead wires are connected to outer supply leads 10 in the region of a pinch 9 that seals the outer bulb 3. The pinch 9 of the outer bulb is seated in a mating opening 11 of a base insulator 12 made from ceramic, and is held there by a metal clip 34. The base is essentially formed from the base insulator 12 and a screw base part 19. This opening 11 is surrounded by a central collar part 13. It projects from a plane that forms the upper plateau 14 of a radially projecting disk-shaped segment 15. The segment 15 is, furthermore, embodied with a side wall 16 and a lower plateau 17. It is seated on a neck part 18 that holds a part assigned to the socket, here a screw base part 19 with thread. The screw base 19 is fastened on the neck part 18 by means of crimping 20. The neck part 18 is hollow inside, the supply leads 10 being connected to electrical connections 21 of the base via an insulation piercing connection 22 in the cavity 23 of the neck part. Other mechanical connection techniques or a conventional welded connection are also similarly suitable.

A jacket 24 that surrounds the outer bulb 3 at a relative large distance, has on the base side an opening 25 that is circularly cylindrical, and whose diameter is adapted to the outside diameter of the segment 15. Between the two parts, which are adapted to one another in shape and dimension it is further possible to insert a buffer part 26 (depicted by dashes in FIG. 3) that can, for example, be a silicone seal.

Figure 3:
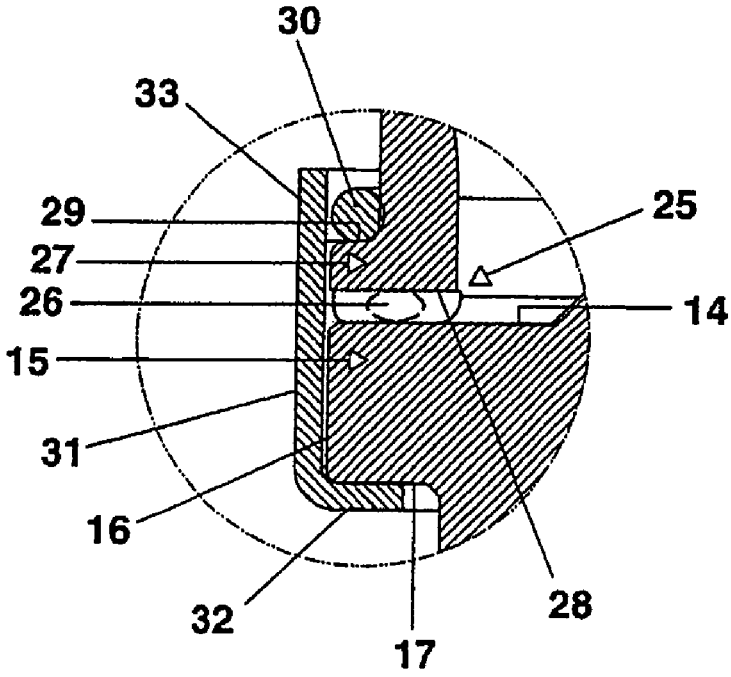
FIG. 3 shows an enlarged detail of the lamp before final fastening.

The jacket 24, see also FIG. 3 in this regard, is equipped at its opening 25 with a radially projecting edge 27. It has a flat lower contact surface 28 that is adapted to the upper plateau 14 of the segment of the base insulator. The upper plateau can have humps that keep the upper plateau 14 at a spacing from the jacket. It also has a narrow upper contact surface 29 that is aligned parallel to the lower contact surface 28 or else obliquely thereto. An elastomer ring 30, for example made from Viton® is seated on it.

Figure 4:
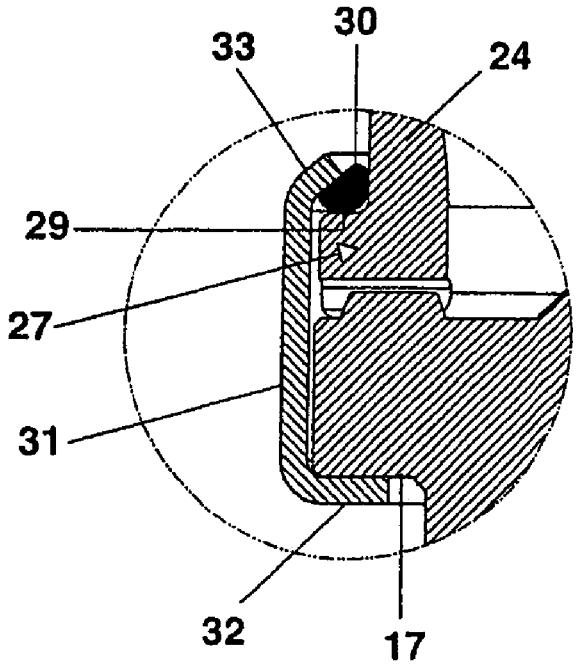
FIG. 4 shows a detail of FIG. 3 after final fastening.

FIG. 3 shows this region in an enlargement before a clamping part is fastened. A clamping ring is shown that is made from an aluminum strip 31 whose lower edge 32 is already angled away such that the strip is pushed on as far as the lower plateau 17, serving as stop, of the segment. The clamping effect is achieved by virtue of the fact that the upper edge 33, which is initially aligned in a straight line, is subsequently rolled upon with the application of force so that it rests on the elastomer ring 30, see FIG. 4. The connecting force presses the jacket 24 against the upper contact surface 29 of the edge 27 over the elastomer ring 30 with a stress that causes the deformation of the ring 30.

Figure 5A:
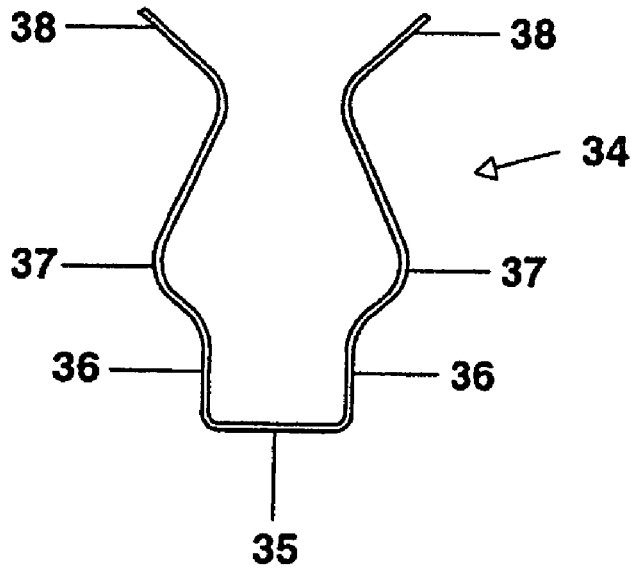
FIG. 5 shows two embodiments of a metal clip.
Figure 5B:
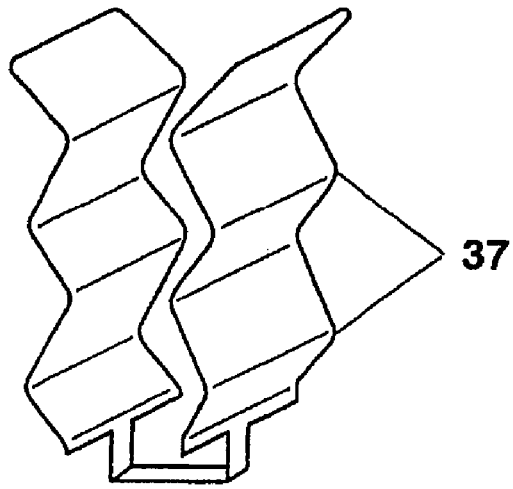

FIG. 5 shows two variants of the metal clip 34 for holding the outer bulb 3 in the base insulator 12. The first variant, FIG. 5*a*, is formed in a U-shaped fashion and equipped with a straight base part 35 and two side walls 36 that have a roof-type camber 37 in the shape of a "V" with the gable pointing outward. The free end 38 of the side wall likewise projects outward. The second variant, FIG. 5*b*, shows two sequentially arranged roof-type cambers 37 in a perspective view, the design otherwise being identical.

Figure 6A:
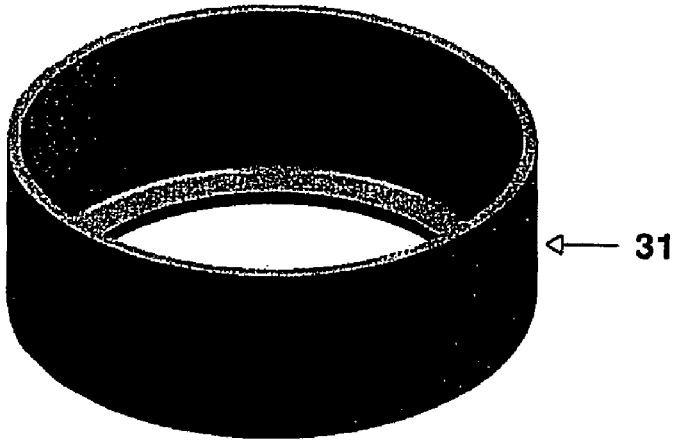
FIG. 6 shows various embodiments of an aluminum ring.

FIG. 6 shows three exemplary embodiments of a clamping strip. The first variant, FIG. 6*a*, shows the aluminum ring 31, described in FIGS. 3 and 4, on its own, before beading. It cooperates with the jacket in accordance with FIG. 7*a*.

Figure 6B:
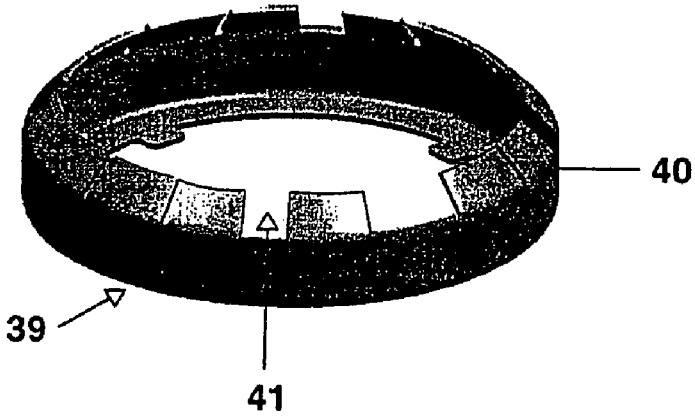
Figure 7A:
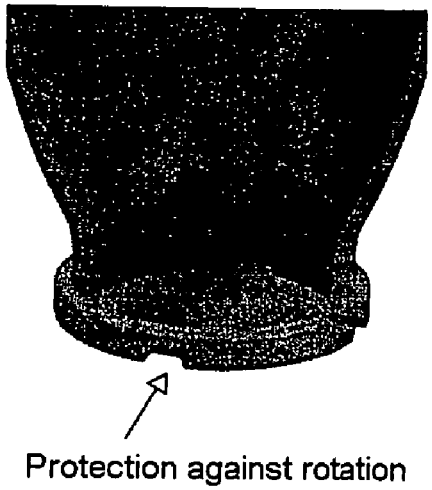
FIG. 7 shows various embodiments of a jacket opening.
Figure 7B:
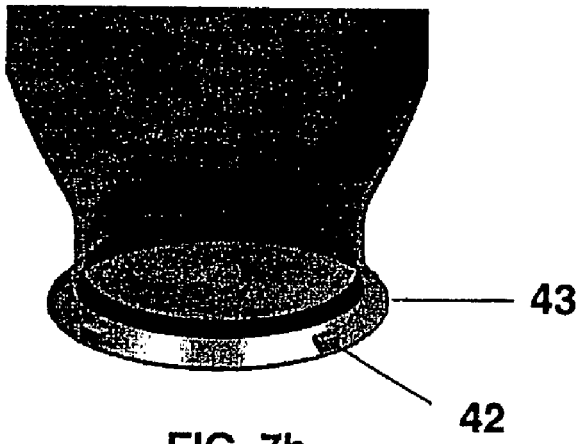

The second variant, FIG. 6*b*, shows an aluminum ring 39 whose upper edge 40 is slotted such that it can be more easily bent over. Cutouts 41 therein correspond to knobs 42 on the edge 43 of the outer jacket, see FIG. 7*b*, that together ensure protection against rotation. In this case, the lower opening of the aluminum ring 39 may not be of circular design.

Figure 6C:
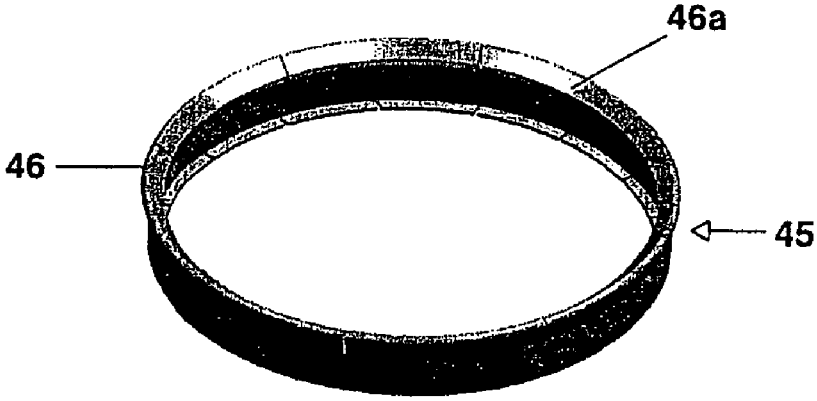
Figure 7C:
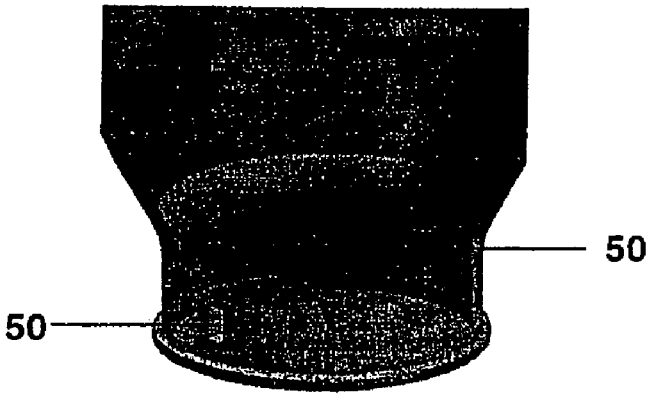
Figure 9:
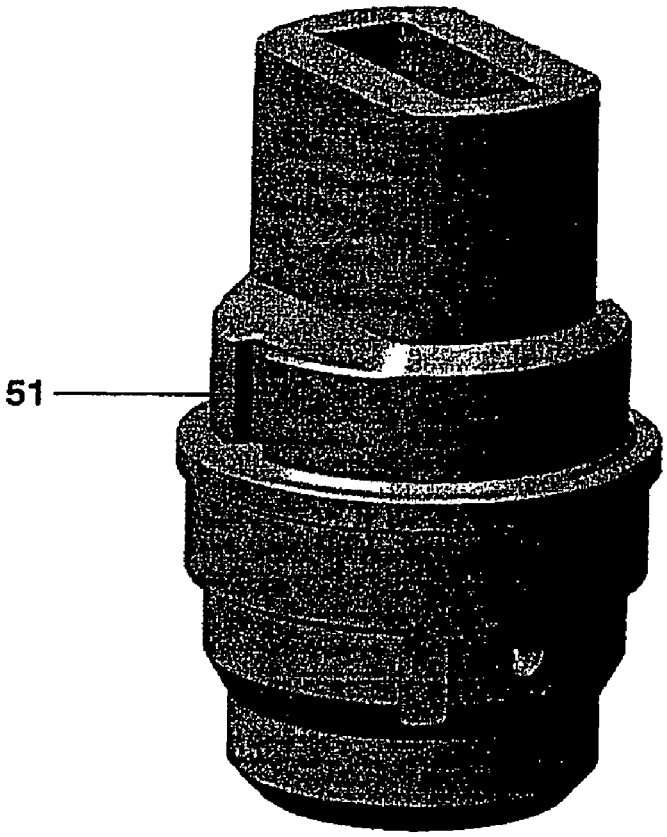
FIG. 9 shows a further exemplary embodiment of a base insulator.

In a third variant of the aluminum ring 45, FIG. 6*c*, the associated edge 44 of the outer jacket (FIG. 7*c*) is relatively weakly pronounced. The aluminum ring 45 itself has an apron 46 that projects obliquely outward and has inwardly pressing spring elements 46*a*. In this variant, the protection against rotation of the jacket relative to the base insulator is implemented by an inwardly shaped projection 50 in the jacket in accordance with FIG. 7*c* and a corresponding cutout 51 in the base insulator, as shown in FIG. 9. This automatically ensures protection against rotation.

Production is performed in the following way in this case. The mounting principle of the apron is the same as for a snap lock. The mounting sequence comprises the following steps:

A) The apron geometry matching the apron is integrally formed on the tube, and the tube is slotted, remaining open on one side;

B) The tube is plugged with its apron over the glass outer bulb until it engages;

C) The tube and outer bulb are pushed over the ceramic (base insulator); and

D) A suitable holding device is used to press the outer bulb over the ring against the ceramic, and then beading is rolled onto the ceramic (screw base side).

A prestressed connection is obtained as final result without the need for an elastomer ring.

It is also possible to introduce between the outer jacket and the ceramic/base insulator a metal ring that, as clamping element, is embodied, for example, as a wave washer or as a spring lock washer, such as disk springs according to DIN 2093, or, in particular, as star-shaped washer or slotted disk spring. However, the clamping element can also be introduced for example, between the roll-on ring and the ceramic/base insulator or between the roll-on ring and the outer jacket. The torque transmission between the outer jacket and the base insulator is introduced in this case radially into the upper end of the base insulator, or else radially into the jacket.

Figure 8:
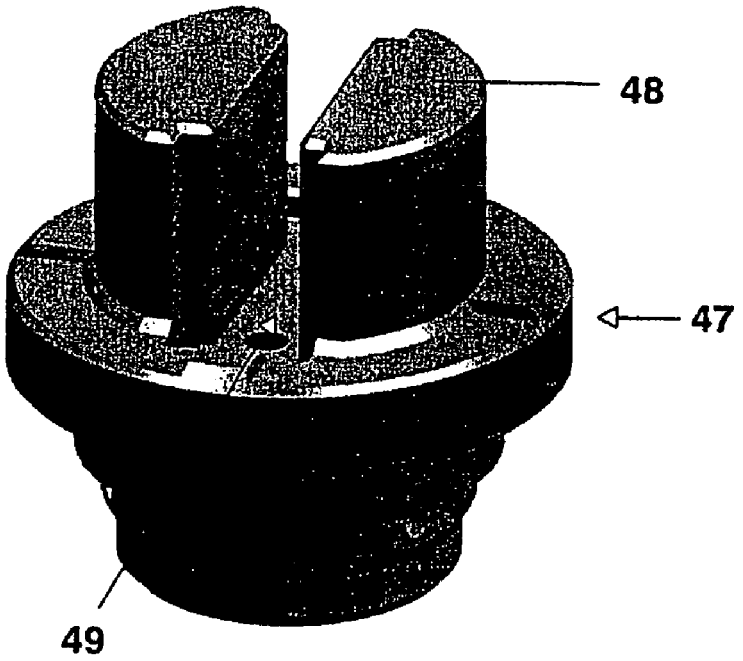
FIG. 8 shows an exemplary embodiment of a base insulator.

FIG. 8 shows a further embodiment of the base insulator 47 in the case of which the collar part 48 does not run completely around the opening, but the wall lacks the collar in part (49).

Figure 10:
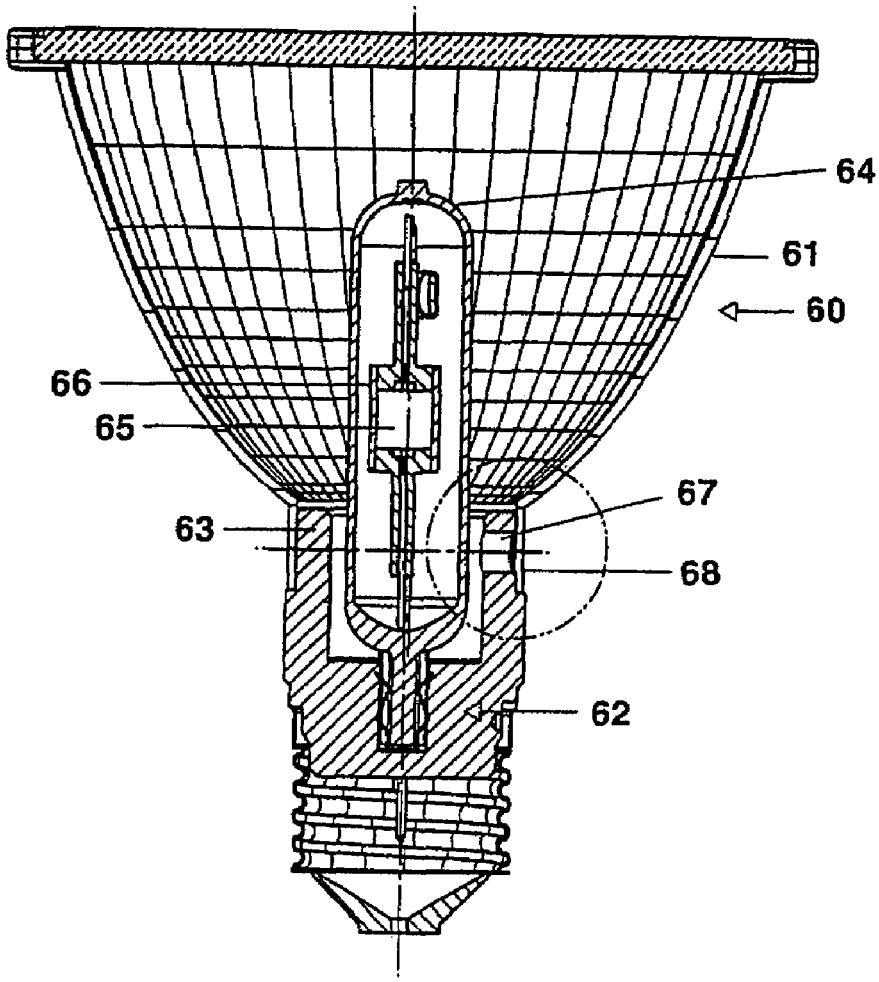
FIG. 10 shows an exemplary embodiment of a reflector lamp.
Figure 11:
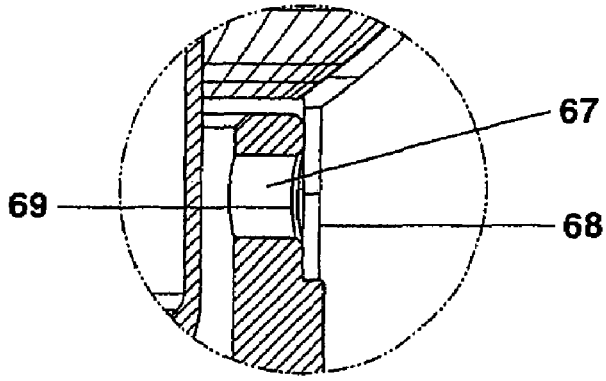
FIG. 11 shows a detail of the reflector lamp.

FIG. 10 shows a reflector lamp 60 having a contour of the reflector part 61 that is produced from aluminum. The base insulator 62 has a pulled up collar 63 that is of cylindrical shape and partially surrounds the outer bulb 64, but ends below the discharge volume 65 of the discharge vessel 66. Radial bores 67 are distributed over the circumference of the collar 63, see detail of FIG. 11. The neck 68 of the reflector is firstly pushed over the collar 63. Then a fastening is implemented by crimping, that is to say pressing the neck 68 into the bores 67. Three dents 69 produced by crimping and distributed over the circumference are sufficient. Surface depressions would also suffice instead of continuous bores.

Figure 12:
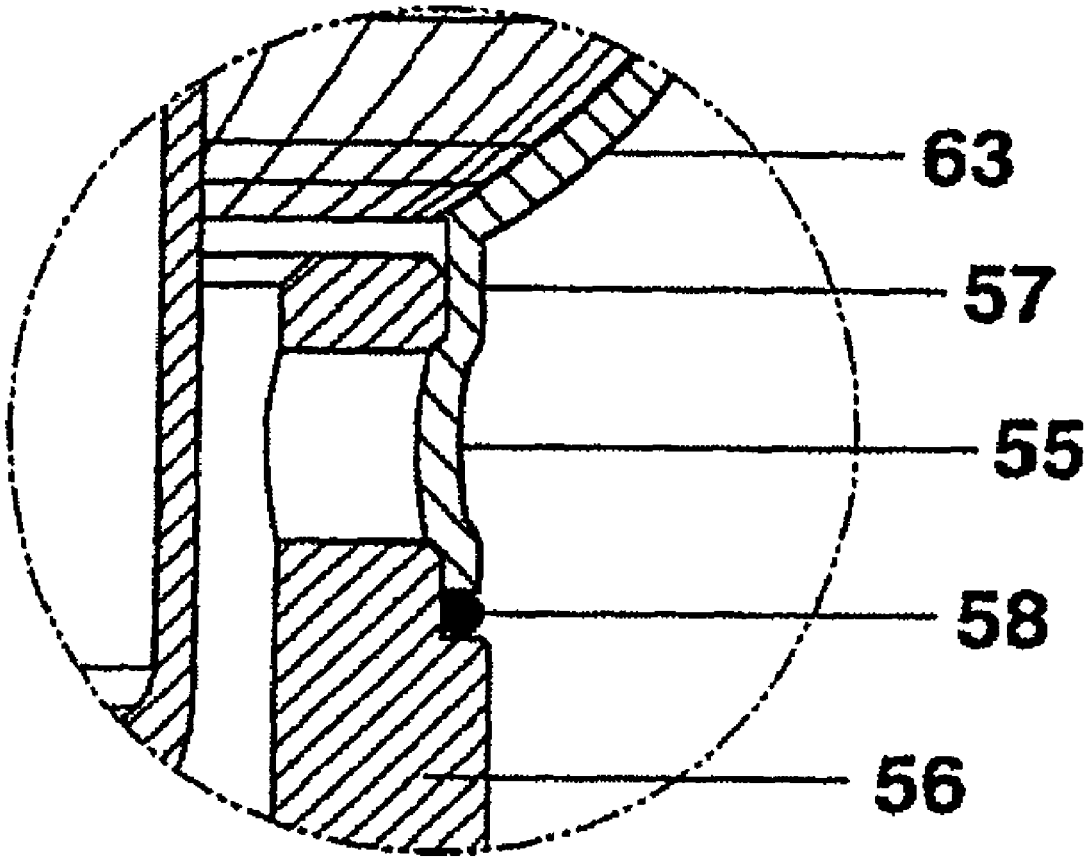
FIG. 12 shows a further exemplary embodiment of the detail of FIG. 11.

In a preferred exemplary embodiment, see FIG. 12, in addition to the integral formation 55 of the aluminum reflector on the ceramic of the base insulator 56, use is made as additional clamping element of an O ring 58 inserted under the edge of the neck.

Instead of a metal ring as deformable ring, it is possible to use a suitable plastic ring that is divided into a number of sections, in particular two halves: one preferred embodiment is a "pot" that comprises a "clip ring" at the top (or else a divided ring in two segments) that is joined by means of ultrasonic welding or laser welding and then holds the jacket and the base insulator together.

In the case of an inner vessel that consists of an outer bulb and discharge vessel, it is of no consequence for the invention whether the discharge vessel or the outer bulb is fastened in the central opening of the base insulator.

The invention claimed is:

1. An electric lamp with a base at one end, the lamp being a high pressure discharge lamp, having an inner vessel (2, 3) with a vacuum-tight seal, said vessel being surrounded by an outer jacket (24), a base with electric connections supporting the inner vessel, on the one hand, and the outer jacket, on the other hand, characterized by the combination of the following features:

a) the base has a base insulator (12) that is produced from an insulating material and has a central opening (11) with a surrounding collar (13; 63) in which the inner vessel is held without cement;

b) the base insulator has a fastening means for the outer jacket, the means being a circular, radially projecting segment with an associated upper and lower plateau with reference to the base;

c) the outer jacket has an opening on the base side, there being located in the vicinity of the opening a means for fastening on the base insulator, in particular a radially projecting edge that has an upper and lower contact surface with reference to the base, the lower contact surface of the edge being compatible with the upper plateau of the circular, radially projecting segment on the base insulator; and d) the outer jacket is fastened on the base by means of a cementless mechanical holding mechanism with the inclusion of the means from b) and c).

2. The lamp as claimed in claim 1, characterized in that the outer jacket is fastened on the base by virtue of the fact that a clamping part bridges the distance between the lower plateau of the base insulator and at least the upper contact surface of the edge, doing so in a holding fashion.

3. The lamp as claimed in claim 1, characterized in that the outer jacket is fastened on the base by virtue of the fact that the outer jacket is fastened on the collar of the base insulator by means of a crimped connection, the base insulator having for this purpose radial bores or depressions that cooperate with dents on the outer jacket.

4. The lamp as claimed in claim 1, characterized in that the inner vessel is a discharge vessel or an outer bulb in which a discharge vessel is accommodated.

5. The lamp as claimed in claim 1, characterized in that the inner vessel is held in the central opening of the base by means of a spring clip.

6. The lamp as claimed in claim 1, characterized in that the edge of the outer jacket and the projecting segment of the base insulator are equipped with means that cooperate as an antirotation mechanism.

7. The lamp as claimed in claim 6, characterized in that the antirotation mechanism is implemented by radially projecting noses on the base insulator and corresponding cutouts at the lower edge of the outer jacket.

8. The lamp as claimed in claim 6, characterized in that the antirotation mechanism is achieved by cutouts or bores in the upper part of the base insulator and beads in the region of the outer jacket at the base end.

9. The lamp as claimed in claim 2, characterized in that the clamping part comprises clamps distributed over the circumference, or a peripheral clamping strip.

10. The lamp as claimed in claim 9, characterized in that the clamping strip is a deformable ring, a multipartite ring joined by bonding, or a ring with resilient elements, or in that the clamps distributed over the circumference are deformable elements joined by means of self-closure, material bonding or force closure, or resilient elements.

11. The lamp as claimed in claim 2, characterized in that a damping means is introduced between the clamping part and the upper contact surface of the edge of the outer jacket, or between the lower contact surface of the edge of the outer jacket and the upper plateau of the base insulator, or between the clamping part and lower plateau of the base insulator.

12. The lamp as claimed in claim 11, characterized in that the damping means is an O ring.

13. The lamp as claimed in claim 1, characterized in that supply leads that make electric contact with the electrical connections via clamping connections are led out of the inner vessel.

14. The lamp as claimed in claim 13, characterized in that the clamping connection is fitted on the supply lead such that the inner vessel is fixed in the base insulator.

15. The lamp as claimed in claim 1, characterized in that the base has a part configured for electrical and mechanical coupling to a lamp socket and is connected at least partially to the base insulator by means of crimping.

16. The lamp as claimed in claim 1, characterized in that the outer jacket is a closed bulb, or has a reflector contour.

17. The lamp as claimed in claim 1, characterized in that the outer jacket is produced from glass or aluminum.

* * * * *